US009703224B2

(12) United States Patent
Yoshie

(10) Patent No.: US 9,703,224 B2
(45) Date of Patent: Jul. 11, 2017

(54) LIQUID DEVELOPER

(71) Applicant: Konica Minolta, Inc., Chiyoda-ku, Tokyo (JP)

(72) Inventor: Naoki Yoshie, Ibaraki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/857,153

(22) Filed: Sep. 17, 2015

(65) Prior Publication Data

US 2016/0085171 A1 Mar. 24, 2016

(30) Foreign Application Priority Data

Sep. 18, 2014 (JP) ..... 2014-190133

(51) Int. Cl.
*G03G 9/00* (2006.01)
*G03G 9/13* (2006.01)

(52) U.S. Cl.
CPC ..... *G03G 9/132* (2013.01)

(58) Field of Classification Search
CPC ..... G03G 9/132
USPC ..... 430/114
See application file for complete search history.

(56) References Cited

U.S. PATENT DOCUMENTS

2012/0315577 A1 12/2012 Moriguchi et al.

FOREIGN PATENT DOCUMENTS

JP 2013-3197 A 1/2013

*Primary Examiner* — Mark A Chapman
(74) *Attorney, Agent, or Firm* — Buchanan Ingersoll & Rooney PC

(57) ABSTRACT

A liquid developer contains an insulating liquid and toner particles dispersed in the insulating liquid. The toner particles have a resin and a coloring agent. The resin contains at least 5 mass % and at most 30 mass % of an aliphatic polyester resin and at least 70 mass % and at most 95 mass % of an aromatic polyester resin. A difference in acid value between the aliphatic polyester resin and the aromatic polyester resin is not less than 15 mgKOH/g and not more than 100 mgKOH/g.

4 Claims, 2 Drawing Sheets

LIQUID DEVELOPER

This application is based on Japanese Patent Application No. 2014-190133 filed with the Japan Patent Office on Sep. 18, 2014, the entire content of which is hereby incorporated by reference.

BACKGROUND OF THE INVENTION

Field of the Invention

The present invention relates to a liquid developer.

Description of the Related Art

Japanese Laid-Open Patent Publication No. 2013-003197 describes toner particles containing a polyester resin. According to this document, document offset can be prevented when a solid obtained by drying a liquid developer has a melting point not lower than 55° C., and the solid of the liquid developer has a melting point not lower than 55° C. by setting a total amount of a constitutional unit derived from an aliphatic monomer occupied in both constitutional units of a constitutional unit derived from an acid component and a constitutional unit derived from an alcohol component to 30 mol % or higher.

SUMMARY OF THE INVENTION

Though Japanese Laid-Open Patent Publication No. 2013-003197 describes fixation of toner particles to a recording medium at 180° C., the liquid developer is required to be fixed at a lower temperature (low-temperature fixability). Unlike a dry developer, the liquid developer can be controlled to have a particle size of toner particles not greater than 2 μm. Therefore, an amount of adhesion of the liquid developer to the recording medium can significantly be smaller than an amount of adhesion of a dry developer to the recording medium, which is advantageous in terms of low-temperature fixability. In addition, as a method for realizing fixation at a low temperature, it has been proposed to enhance meltability of a resin contained in toner particles or to employ a resin high in sharp-melting property (for example, a polyester resin).

When an amorphous polyester resin is employed as a resin to be contained in toner particles, a softening point thereof can be lowered by adjusting a molecular weight or the like of the amorphous polyester resin. Therefore, fixation at a low temperature (for example, fixation at 90° C.) can be achieved. With lowering in softening point of the amorphous polyester resin, however, a glass transition point thereof also lowers, which leads to lowering in heat resistance of the toner particles. For example, it becomes difficult for toner particles to be resistant to heat at 50° C. or higher.

On the other hand, a crystalline polyester resin has a melting point lower than the softening point of the amorphous polyester resin. Therefore, use of the crystalline polyester resin as a resin to be contained in toner particles can allow fixation at a low temperature without lowering in heat resistance of the toner particles. Therefore, use of the crystalline polyester resin as the resin to be contained in toner particles is preferred.

The crystalline polyester resin is mainly composed of an aliphatic monomer, while the amorphous polyester resin is mainly composed of an aromatic monomer. Here, since a resin composed of an aliphatic monomer is softer than a resin composed of an aromatic monomer, it tends to be weak against stress. Therefore, use of the crystalline polyester resin as the resin to be contained in toner particles may lead to aggregation of toner particles with application of stress in a development apparatus. Aggregation of toner particles is noticeable in a NIP portion, between rollers, or between a roller and a blade in a development apparatus.

In the liquid developer, since a resin contained in toner particles is in contact with an insulating liquid, it tends to be swollen with the insulating liquid and plasticized, and hence it tends to be weak against stress. Consequently, aggregation of toner particles is likely.

The present invention was made in view of such aspects, and an object of the present invention is to achieve both of improvement in fixability of toner particles at a low temperature and improvement in resistance to aggregation of toner particles.

A resin composed of an aromatic monomer is harder than a resin composed of an aliphatic monomer. Therefore, it is expected that use of an aromatic polyester resin as a resin to be contained in toner particles can enhance resistance to aggregation of the toner particles. When fixation at a low temperature is attempted only with an aromatic polyester resin as the resin to be contained in toner particles, however, heat resistance of toner particles is lowered.

On the other hand, when only an aliphatic polyester resin is employed as the resin to be contained in toner particles, only a crystalline polyester resin will be employed as the resin to be contained in toner particles. Therefore, the toner particles can be fixed at a low temperature without lowering in heat resistance of the toner particles. Resistance to aggregation of the toner particles, however, is lowered.

From the foregoing, the present inventors have assumed that, by using both of an aliphatic polyester resin and an aromatic polyester resin as resins to be contained in toner particles, the toner particles can be fixed at a low temperature without lowering in heat resistance of the toner particles and in addition resistance to aggregation of the toner particles can be improved. Then, the present inventors have formed toner particles with both of an aliphatic polyester resin and an aromatic polyester resin, and examined characteristics of the toner particles. Then, it has been found that the toner particles aggregate in some cases.

In order to find out the cause of such a result, the present inventors have analyzed toner particles which have not aggregated and toner particles which have aggregated. Consequently, in the toner particles which have not aggregated, the aliphatic polyester resin and the aromatic polyester resin were not compatible with each other, whereas in the toner particles which have aggregated, the aliphatic polyester resin and the aromatic polyester resin were compatible with each other. Furthermore, the present inventors have assumed that, when the aliphatic polyester resin and the aromatic polyester resin are compatible with each other, the resins become soft owing to addition of the aliphatic polyester resin and hence resistance to aggregation of toner particles may lower. Based on such assumption, the liquid developer according to the present invention was completed.

A liquid developer according to the present invention contains an insulating liquid and toner particles dispersed in the insulating liquid. The toner particles contain a resin and a coloring agent. The resin contains at least 5 mass % and at most 30 mass % of an aliphatic polyester resin and at least 70 mass % and at most 95 mass % of an aromatic polyester resin. A difference in acid value between the aliphatic polyester resin and the aromatic polyester resin is not less than 15 mgKOH/g and not more than 100 mgKOH/g.

A polyester resin is synthesized through polycondensation reaction between carboxylic acid (a constitutional unit derived from an acid component) and alcohol (a constitutional unit derived from an alcohol component). Therefore, a portion derived from carboxylic acid becomes a constitutional unit derived from the acid component, a portion derived from alcohol becomes a constitutional unit derived from the alcohol component, and a polyester resin is constructed as these constitutional units are repeated.

An "aliphatic polyester resin" means that, in an aliphatic polyester resin, a content of a constitutional unit derived from an aliphatic monomer in both constitutional units of a constitutional unit derived from an alcohol component and a constitutional unit derived from an acid component is not lower than 90 mass %. A "constitutional unit derived from an alcohol component" means a constitutional unit with a hydrogen atom having been removed from a hydroxyl group (an OH group) contained in alcohol, and includes a constitutional unit with a hydrogen atom having been removed from at least one hydroxyl group contained in alcohol. A "constitutional unit derived from an acid component" means a constitutional unit with a hydroxyl group having been removed from a carboxyl group (a COOH group) of carboxylic acid and includes a constitutional unit with a hydroxyl group having been removed from at least one carboxyl group contained in carboxylic acid. The "aliphatic monomer" includes aliphatic carboxylic acid, ester of lower alkyl of aliphatic carboxylic acid, acid anhydride of aliphatic carboxylic acid, and aliphatic alcohol. "Aliphatic carboxylic acid" means carboxylic acid not having an aromatic ring. "Aliphatic alcohol" means alcohol not having an aromatic ring.

An "aromatic polyester resin" means that, in an aromatic polyester resin, a content of a constitutional unit derived from an aromatic monomer in both constitutional units of a constitutional unit derived from an alcohol component and a constitutional unit derived from an acid component is not lower than 90 mass %. The "aromatic monomer" includes aromatic carboxylic acid, ester of lower alkyl of aromatic carboxylic acid, acid anhydride of aromatic carboxylic acid, and aromatic alcohol. "Aromatic carboxylic acid" means carboxylic acid having an aromatic ring. "Aromatic alcohol" means alcohol having an aromatic ring.

An "acid value of an aliphatic polyester resin" means an acid value of an aliphatic polyester resin measured in compliance with a method described under JIS K 0070: 1992 (test methods for acid value, saponification value, ester value, iodine value, hydroxyl value and unsaponifiable matter of chemical products), and is based on an amount of carboxyl groups contained in an aliphatic polyester resin. A "carboxyl group contained in an aliphatic polyester resin" is based on an amount of residues of carboxyl groups which have not reacted with hydroxyl groups during condensation polymerization reaction for synthesis of an aliphatic polyester resin.

An "acid value of an aromatic polyester resin" means an acid value of an aromatic polyester resin measured in compliance with the method described under JIS K 0070: 1992, and is based on an amount of carboxyl groups contained in an aromatic polyester resin. A "carboxyl group contained in an aromatic polyester resin" is based on an amount of residues of carboxyl groups which have not reacted with hydroxyl groups during condensation polymerization reaction for synthesis of an aromatic polyester resin.

Preferably, a resin has an acid value not less than 20 mgKOH/g and not more than 100 mgKOH. An "acid value of a resin" means an acid value of a resin (a resin component contained in a liquid developer) measured in compliance with the method described under JIS K 0070: 1992, and is based on an amount of carboxyl groups contained in such a resin component. A resin component contained in a liquid developer includes an aliphatic polyester resin and an aromatic polyester resin.

Preferably, a difference in acid value between the aliphatic polyester resin and the aromatic polyester resin is not less than 20 mgKOH/g and not more than 100 mgKOH/g. Preferably, the resin contains at least 5 mass % and at most 25 mass % of the aliphatic polyester resin.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[Liquid Developer]

Figure 1:
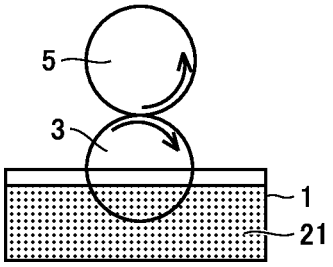
FIG. 1 is a side view of an apparatus used for evaluating resistance to aggregation of a liquid developer.

A liquid developer according to the present embodiment is useful as a liquid developer for electrophotography used in an image formation apparatus of an electrophotography type (which will be described later) such as a copying machine, a printer, a digital printer, or a simple printer, a paint, a liquid developer for electrostatic recording, an oil-based ink for ink jet printer, or an ink for electronic paper. The liquid developer according to the present embodiment contains an insulating liquid and toner particles dispersed in the insulating liquid, and preferably contains 10 to 50 mass % of toner particles and 50 to 90 mass % of the insulating liquid. The liquid developer according to the present embodiment may contain an optional component different from the insulating liquid and the toner particles. Such an optional component includes, for example, a toner dispersant, a charge control agent, or a thickener.

Toner Particles

Toner particles in the present embodiment have a resin and a coloring agent dispersed in the resin, and preferably have 50 to 90 mass % of the resin and 10 to 50 mass % of the coloring agent. The toner particles according to the present embodiment may contain an optional component different from the resin and the coloring agent. Such an optional component includes, for example, a dispersant for a pigment, a wax, or a charge control agent.

A median diameter D50 found through measurement of particle size distribution of toner particles based on volume (hereinafter denoted as "median diameter D50 of toner particles") is preferably not smaller than 0.5 μm and not greater than 5.0 μm. This median diameter is smaller than a particle size of toner particles contained in a conventional dry developer, and represents one of the features of the present embodiment. If a median diameter D50 of toner particles is not smaller than 0.5 μm, a particle size of the toner particles can be ensured and hence mobility of toner particles in electric field is improved and development performance can be enhanced. If a median diameter D50 of toner particles is not greater than 5 dispersibility of the toner particles can be ensured and hence image quality can be enhanced. More preferably, toner particles have a median diameter D50 not smaller than 1.0 μm and not greater than 2.0 μm.

Average circularity of toner particles is preferably not lower than 0.85 and not higher than 0.95 and a standard deviation of circularity of toner particles is not lower than 0.01 and not higher than 0.1. Thus, transferability and ease of cleaning improve. "Circularity" means a numeric value obtained by dividing a circumferential length of a circle equal in area to a two-dimensionally projected area of particles by a circumferential length of particles. "Average circularity" means an arithmetic mean value of calculated circularity.

Median diameter D50 of toner particles, average circularity of toner particles, and standard deviation of circularity of toner particles can be measured, for example, with a flow particle image analyzer ("FPIA-30005" (model number) manufactured by Sysmex Corporation). This analyzer can use a solvent as it is as a dispersion medium. Therefore, this analyzer can measure a state of toner particles in a state closer to an actually dispersed state, as compared with a system in which measurement is conducted in a water system.

Resin (Content of Aliphatic Polyester Resin and Content of Aromatic Polyester Resin)

A resin contained in toner particles includes at least 5 mass % and at most 30 mass % of an aliphatic polyester resin and at least 70 mass % and at most 95 mass % of an aromatic polyester resin. When a content of the aliphatic polyester resin (a ratio of a mass of the aliphatic polyester resin to a mass of resins contained in the toner particles) is not lower than 5 mass %, a content of a resin low in melting point (an aliphatic polyester resin) can be ensured and hence fixation at a low temperature can be achieved. When a content of the aliphatic polyester resin is not higher than 30 mass %, a content of a hard resin (an aromatic polyester resin) can be ensured and hence resistance to aggregation of the toner particles can be enhanced. Preferably, a content of the aliphatic polyester resin is not lower than 5 mass % and not higher than 25 mass %. Since a content of a hard resin can thus further be ensured, resistance to aggregation of the toner particles can further be enhanced.

When a content of the aromatic polyester resin (a ratio of a mass of the aromatic polyester resin to a mass of resins contained in the toner particles) is not lower than 70 mass %, a content of a hard resin (the aromatic polyester resin) can be ensured and hence resistance to aggregation of the toner particles can be enhanced. When a content of the aromatic polyester resin is not higher than 95 mass %, a content of the resin low in melting point (the aliphatic polyester resin) can be ensured and hence fixation at a low temperature can be achieved. Preferably, the content of the aromatic polyester resin is not lower than 75 mass % and not higher than 95 mass %. Since a content of the hard resin can thus further be ensured, resistance to aggregation of the toner particles can further be enhanced.

A content of the aliphatic polyester resin and a content of the aromatic polyester resin can be determined by conducting $^{1}$H-NMR analysis with a Fourier transform nuclear magnetic resonance spectrometer (FT-NMR) (trade name: "Lambda 400" manufactured by JEOL Ltd.) and finding an integration ratio. A chloroform-d (deuterochloroform) solvent can be employed as a measurement solvent. A content of a constitutional unit derived from an aliphatic monomer in both constitutional units of a constitutional unit derived from an alcohol component and a constitutional unit derived from an acid component and a content of a constitutional unit derived from an aromatic monomer in both constitutional units of a constitutional unit derived from an alcohol component and a constitutional unit derived from an acid component can also be measured with a similar method.

(Difference in Acid Value)

A difference in acid value between an aliphatic polyester resin and an aromatic polyester resin (which may hereinafter also be denoted as a "difference in acid value") is not less than 15 mgKOH/g and not more than 100 mgKOH/g. When the difference in acid value is not less than 15 mgKOH/g, a difference between an amount of carboxyl groups contained in the aliphatic polyester resin and an amount of carboxyl groups contained in the aromatic polyester resin is greater and hence a difference in solubility parameter (SP) value between the aliphatic polyester resin and the aromatic polyester resin is greater. Thus, affinity between the aliphatic polyester resin and the aromatic polyester resin lowers. Namely, the aliphatic polyester resin and the aromatic polyester resin are less likely to be compatible with each other.

Here, the aliphatic polyester resin is lower in content than the aromatic polyester resin. Therefore, the aliphatic polyester resin (a soft resin) is surrounded by the aromatic polyester resin (a hard resin) (formation of a sea-island structure), so that resistance to aggregation of toner particles is enhanced. Preferably, the difference in acid value is not less than 20 mgKOH/g.

Various methods are available as a method of increasing a difference in SP value between the aliphatic polyester resin and the aromatic polyester resin. Increase in difference in acid value, however, can bring about effective increase in difference in SP value between the aliphatic polyester resin and the aromatic polyester resin.

With the difference in acid value not more than 100 mgKOH/g, formation of a three-dimensional structure (a cross-linked structure) due to carboxyl groups in a resin contained in toner particles can be prevented. Therefore, since meltability of a resin contained in toner particles at a low temperature can be ensured, fixation at a low temperature can be achieved. Actually, it is difficult to increase the difference in acid value to more than 100 mgKOH/g.

So long as a difference in acid value is not less than 15 mgKOH/g and not more than 100 mgKOH/g, the aliphatic polyester resin may be higher in acid value than the aromatic polyester resin or the aromatic polyester resin may be higher in acid value than the aliphatic polyester resin.

A method of adjusting an acid value of the aliphatic polyester resin includes, for example, changing a type of a constitutional unit derived from an alcohol component or a type of a constitutional unit derived from an acid component, changing a molar ratio in mixing between a monomer which is a constitutional unit derived from an alcohol component and a monomer which is a constitutional unit derived from an acid component, or changing a condition for condensation reaction. An acid value of the aromatic polyester resin can be adjusted with a similar method. By adopting any method of these, a difference in acid value can be adjusted to a value not less than 15 mgKOH/g and not more than 100 mgKOH/g. In the case of the aromatic polyester resin, an acid value of the aromatic polyester resin can be increased by using a monomer containing three or more carboxyl groups (a monomer which is a constitutional unit derived from an acid component).

(Acid Value of Resin)

A resin has an acid value preferably not less than 20 mgKOH/g and not more than 100 mgKOH/g. When the resin has an acid value not less than 20 mgKOH/g, adhesiveness between toner particles as dispersed in an insulating liquid and a recording medium can be ensured. Thus, fixation strength of toner particles to the recording medium can be ensured. When at least one of the aliphatic polyester resin and the aromatic polyester resin has a constitutional unit containing three or more functional groups as a constitutional unit derived from an acid component, an acid value of the resin can readily be adjusted to a value not less than 20 mgKOH/g and not more than 100 mgKOH/g. It is difficult to increase an acid value of the resin to more than 100 mgKOH/g.

(Constitutional Unit)

Examples of an aliphatic monomer which is a constitutional unit derived from an acid component include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, or 1,18-octadecanedicarboxylic acid. Ester of lower alkyl thereof or acid anhydride thereof may be employed. From a point of view of promotion of crystallinity of a polyester resin, adipic acid, sebacic acid, 1,10-decanedicarboxylic acid, or 1,12-dodecanedicarboxylic acid is more preferably employed. As such an aliphatic monomer, any of the above may be used alone or any two or more of the above may be used as combined.

Examples of an aliphatic monomer which is a constitutional unit derived from an alcohol component include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, or 1,20-eicosanediol. From a point of view of promotion of crystallinity of a polyester resin, ethylene glycol, 1,4-butanediol, 1,6-hexanediol, 1,9-nonanediol, or 1,10-decanediol is preferably employed. As such an aliphatic monomer, any of the above may be used alone or any two or more of the above may be used as combined.

Examples of an aromatic monomer which is a constitutional unit derived from an acid component include aromatic polycarboxylic acid, ester of lower alkyl of aromatic polycarboxylic acid, or acid anhydride of aromatic polycarboxylic acid. Specific examples include terephthalic acid, isophthalic acid, orthophthalic acid, 5-tert-butylisophthalic acid, 2,6-naphthalene dicarboxylic acid, 4,4'-biphenyldicarboxylic acid, or trimellitic acid (having three functional groups). From a point of view of availability, terephthalic acid, isophthalic acid, or 5-tert-butylisophthalic acid is preferably employed.

An aromatic monomer which is a constitutional unit derived from an alcohol component can include aromatic polyalcohol. Specifically, an adduct of alkylene oxide to bisphenol A expressed in a chemical formula (I) below can be exemplified.

(I)

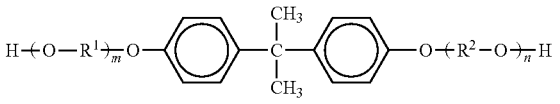

In the chemical formula (I), $R^1$ and $R^2$ each independently represent an alkylene group having a carbon number 2 or 3. m and n each independently represent 0 or a positive integer. The sum of m and n is not smaller than 1 and not greater than 16.

An aliphatic polyester resin has a number average molecular weight (Mn) preferably not smaller than 1000 and not greater than 25000, and the aliphatic polyester resin has a mass average molecular weight (Mw) preferably not smaller than 2000 and not greater than 200000. An aromatic polyester resin has a number average molecular weight (Mn) preferably not smaller than 1000 and not greater than 25000, and the aromatic polyester resin has a mass average molecular weight (Mw) preferably not smaller than 2000 and not greater than 200000. A number average molecular weight and a mass average molecular weight can be measured with gel permeation chromatography (GPC).

A resin contained in toner particles may contain less than 10 mass % of a resin other than the aliphatic polyester resin and the aromatic polyester resin. Examples of a resin other than the aliphatic polyester resin and the aromatic polyester resin include a styrene-acrylic resin, a urethane resin, or an epoxy resin. When the content of other resins is not lower than 10 mass %, it may become difficult to regularly arrange molecular chains of a polyester resin.

(Crystallinity)

When a heat of melting of a resin (a resin contained in toner particles) measured with differential scanning calorimetry (DSC) satisfies expressions (1) and (2) below, that resin is defined as a crystalline resin:

$$2 \leq H1 \leq 100 \quad \text{Expression (1)}$$

$$0.2 \leq H2/H1 \leq 1.0 \quad \text{Expression (2)}$$

where H1 represents heat of fusion (J/g) at the time of initial temperature increase with DSC and H2 represents heat of fusion (J/g) at the time of second temperature increase with DSC.

H1 is an index of a rate of melting of the resin. In general, since a resin having heat of fusion has sharp-melting capability, it can be molten with less energy. When the resin has H1 exceeding 100, it is difficult to lower fixation energy, which hence leads to lowering in fixability of toner particles. When the resin has H1 lower than 5, fixation energy is excessively low, which leads to tendency of occurrence of document offset. When the resin has H1 satisfying the expression (1), occurrence of document offset can be prevented and lowering in fixability of the toner particles can be prevented. Preferably, relation of $15 \leq H1 \leq 80$ is satisfied and more preferably relation of $35 \leq H1 \leq 70$ is satisfied.

H2/H1 in the expression (2) above is an index of a rate of crystallization of the resin. In general, in a case where particles made of a resin (resin particles) are used as they are molten and thereafter cooled, if a non-crystallized portion is present in crystal components in the resin particles, such a disadvantage that a resistance value of the resin particles is lowered or the resin particles are plasticized is caused. If such a disadvantage is caused, performance of the resin particles obtained by cooling may be different from performance as originally designed. From the foregoing, it is necessary to quickly crystallize crystal components in the resin particles and to avoid influence on performance of the resin particles. H2/H1 is more preferably not lower than 0.3 and further preferably not lower than 0.4. If a rate of crystallization of the resin is high, H2/H1 is close to 1.0 and hence H2/H1 preferably takes a value close to 1.0.

H2/H1 in the expression (2) above does not exceed 1.0 theoretically, however, a value actually measured with DSC may exceed 1.0. Even a case where a value (H2/H1) actually measured with DSC exceeds 1.0 is also assumed to satisfy the expression (2) above.

H1 and H2 can be measured in compliance with "testing methods for heat of transitions of plastics" under JIS-K7122 (1987). Specifically, initially, 5 mg of a resin is taken and introduced in an aluminum pan. With a differential scanning calorimetry apparatus (such as a model number "RDC220" manufactured by SII Nano Technology Inc. or a model number "DSC20" manufactured by Seiko Instruments Inc.) and with a rate of temperature increase being set to 10° C./min., a temperature at a heat absorption peak of the resin owing to melting (melting point) is measured and an area S1 of a heat absorption peak is found. H1 can be calculated from found area S1 of the heat absorption peak. After H1 is calculated, a rate of cooling is set to 90° C./min., thereafter cooling to 0° C. is carried out, a rate of temperature increase is set to 10° C./min., a temperature at a heat absorption peak of the resin owing to melting (melting point) is measured, and an area S2 of a heat absorption peak is found. H2 can be calculated from found area S2 of the heat absorption peak.

H1 and H2 can be measured also in accordance with a method shown below with a differential scanning calorimeter (such as a model number "DSC210" manufactured by Seiko Instruments Inc.). Initially, a standard sample and a resin are heated from 0° C. to 180° C. at a rate of 10° C./min., and a difference between an amount of heat of the standard sample and an amount of heat of the resin is measured. The measured difference in amount of heat is heat of melting H1 with DSC of the resin. Thereafter, after cooling to 0° C. is carried out at a cooling rate of 90° C./min., the standard sample and the resin are heated from 0° C. to 180° C. at a rate of 10° C./min., and a difference between an amount of heat of the standard sample and an amount of heat of the resin is measured. The measured difference in amount of heat is heat of melting H2 with DSC of the resin.

Coloring Agent

A coloring agent is dispersed in at least one of an aliphatic polyester resin and an aromatic polyester resin, and has a particle size preferably not larger than 0.3 μm. When a coloring agent has a particle size not larger than 0.3 μm, dispersibility of the coloring agent can further be enhanced, and hence a degree of gloss of an image can further be enhanced. Therefore, a desired color is readily realized.

Though a conventionally known pigment can be employed as a coloring agent without being particularly limited, from a point of view of cost, light resistance, coloring capability, and the like, pigments below are preferably employed. In terms of color construction, these pigments are normally categorized into a black pigment, a yellow pigment, a magenta pigment, and a cyan pigment. Colors (color images) other than black are basically toned by subtractive color mixture of a yellow pigment, a magenta pigment, or a cyan pigment. A pigment shown below may be used alone, or two or more types of pigments shown below may be used together as necessary.

A pigment contained in a black coloring agent (a black pigment) may be, for example, carbon black such as furnace black, channel black, acetylene black, thermal black, or lamp black, carbon black derived from biomass, or magnetic powders of magnetite or ferrite. Nigrosine (an azine-based compound) which is a purple-black dye may be used alone or in combination. As nigrosine, C. I. Solvent Black 7 or C. I. Solvent Black 5 can be employed.

Examples of a pigment contained in a magenta coloring agent (a magenta pigment) include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, or C. I. Pigment Red 222.

Examples of a pigment contained in a yellow coloring agent (a yellow pigment) include C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 138, C. I. Pigment Yellow 155, C. I. Pigment Yellow 180, or C. I. Pigment Yellow 185.

Examples of a pigment contained in a cyan coloring agent (a cyan pigment) include C. I. Pigment Blue 15, C. I. Pigment Blue 15:2, C. I. Pigment Blue 15:3, C. I. Pigment Blue 15:4, C. I. Pigment Blue 16, C. I. Pigment Blue 60, C. I. Pigment Blue 62, C. I. Pigment Blue 66, or C. I. Pigment Green 7.

Optional Component in Toner Particles (Dispersant for Pigment)

A dispersant for pigment is exemplified as one example of an optional component in toner particles. A dispersant for pigment has a function to uniformly disperse a coloring agent (a pigment) in toner particles and it is preferably a basic dispersant. The basic dispersant refers to a dispersant defined below. Namely, 0.5 g of a dispersant for pigment and 20 ml of distilled water are introduced in a screw bottle made of glass, the screw bottle is shaken for 30 minutes with the use of a paint shaker, and the resultant product is filtered. pH of a filtrate thus obtained is measured with a pH meter (trade name: "D-51" manufactured by Horiba, Ltd.), and a filtrate of which pH is higher than 7 is defined as a basic dispersant. It is noted that a filtrate of which pH is lower than 7 is referred to as an acid dispersant.

A type of such a basic dispersant is not particularly limited. For example, a basic dispersant is preferably a compound having a functional group such as an amine group, an amino group, an amide group, a pyrrolidone group, an imine group, an imino group, a urethane group, a quaternary ammonium group, an ammonium group, a pyridino group, a pyridium group, an imidazolino group, or an imidazolium group in a molecule. It is noted that what is called a surfactant having a hydrophilic portion and a hydrophobic portion in a molecule normally falls under the dispersant. Various compounds, however, can be employed without limited to the surfactant, so long as they have a function to uniformly disperse a coloring agent (a pigment) in toner particles.

A commercially available product of such a basic dispersant may be, for example, "Ajisper PB-821" (trade name), "Ajisper PB-822" (trade name), or "Ajisper PB-881" (trade name) manufactured by Ajinomoto Fine-Techno Co., Inc., or "Solsperse 28000" (trade name), "Solsperse 32000" (trade name), "Solsperse 32500" (trade name), "Solsperse 35100" (trade name), or "Solsperse 37500" (trade name) manufactured by Japan Lubrizol Limited.

A dispersant for pigment not dissolved in an insulating liquid is more preferably selected. In consideration of this point, "Ajisper PB-821" (trade name), "Ajisper PB-822" (trade name), or "Ajisper PB-881" (trade name) manufactured by Ajinomoto Fine-Techno Co., Inc. is more preferably employed. By using such a dispersant for pigment, it becomes easier to obtain toner particles having a desired shape, although a detailed mechanism is not known.

Preferably 1 to 100 mass % and more preferably 1 to 40 mass % of such a dispersant for pigment is added to the coloring agent (pigment). When an amount of addition of the dispersant for pigment is not lower than 1 mass %, dispersibility of the coloring agent (pigment) can be ensured, and hence necessary ID (image density) can be achieved and fixation strength can be ensured. When an amount of addition of the dispersant for pigment is not higher than 100 mass %, the amount of addition of the dispersant for pigment can be prevented from being excessive. Therefore, the excessive dispersant for pigment can be prevented from being dissolved in the insulating liquid, and hence chargeability or fixation strength of toner particles can be maintained in a satisfactory state. Such a dispersant for pigment may be used alone or two or more types of the dispersants for pigment may be used together as necessary.

Insulating Liquid

The insulating liquid has a resistance value preferably to such an extent as not distorting an electrostatic latent image (approximately from $10^{11}$ to $10^{16}$ Ω·cm) and preferably it is a solvent having low odor and toxicity. The insulating liquid is generally exemplified by aliphatic hydrocarbon, alicyclic hydrocarbon, aromatic hydrocarbon, halogenated hydrocarbon, or polysiloxane. In particular from a point of view of low odor and low harm as well as low cost, preferably a normal paraffin based solvent or an isoparaffin based solvent is employed as the insulating liquid. More preferably, Moresco White (trade name, manufactured by MORESCO Corporation), Isopar (trade name, manufactured by Exxon Mobil Corporation), or Shellsol (trade name, manufactured by Shell Chemicals Japan Ltd.) is employed, or IP Solvent 1620, IP Solvent 2028, or IP Solvent 2835 (each of which is trade name and manufactured by Idemitsu Kosan Co., Ltd.) is employed.

Optional Component in Liquid Developer (Toner Dispersant)

A toner dispersant represents one example of an optional component in a liquid developer. The toner dispersant has a function to uniformly disperse toner particles in a liquid developer and essentially contains a basic high-polymer dispersant, for a reason shown below.

A resin contained in toner particles has a carboxyl group at the terminal. Therefore, when the basic high-polymer dispersant is employed as the toner dispersant, a good dispersed state of toner particles can be maintained for a long period of time owing to an interaction between the carboxyl group and the basic high-polymer dispersant.

Since the insulating liquid is captured by the toner particles with the toner dispersant being interposed, in general, an amount of addition of the toner dispersant is desirably suppressed. As the amount of addition of the toner dispersant increases, an amount of insulating liquid which remains on a recording medium together with the toner particles after fixation of the toner particles increases. Then, the toner particles are plasticized and hence document offset tends to occur.

When a basic high-polymer dispersant is employed as the toner dispersant, however, the interaction above occurs between the toner particles and the resin. Therefore, in spite of an amount of addition of the toner dispersant being small, dispersibility of the toner particles in the liquid developer can be enhanced. Therefore, since an amount of insulating liquid captured by the toner particles decreases, occurrence of document offset can extremely effectively be prevented.

Furthermore, the basic high-polymer dispersant is considered to readily separate from toner particles owing to heat during fixation of the toner particles. Since an amount of insulating liquid captured by the toner particles decreases also in this regard, occurrence of document offset can effectively be prevented.

For example, a nitrogen-containing resin having an amine group, an amide group, an imine group, a pyrrolidone group, or a urethane group in a molecule is preferred as such a basic high-polymer dispersant. In particular, a nitrogen-containing resin containing any of an amide group, a pyrrolidone group, and a urethane group in a molecule is suitable. With the use of a basic high-polymer dispersant as the toner dispersant, an amount of addition of the toner dispersant can further be suppressed.

Examples of a nitrogen-containing resin containing a urethane group in a molecule include a copolymer of a compound obtained through reaction between a compound having a hydroxyl group at the terminal and an isocyanate group and a vinyl compound having a long-chain alkyl group. Examples of a compound having a hydroxyl group at the terminal include hydroxyethyl methacrylate or hydroxyethyl acrylate. Examples of a compound having an isocyanate group include tolylenediisocyanate or isophoronediisocyanate.

Specific examples of a basic high-polymer dispersant include "Disperbyk-109 (alkylolamino amide)" (trade name) or "Disperbyk-130 (polyamine amides of unsaturated polycarboxylic acids)" (trade name) manufactured by BYK-Chemie GmbH and "Solsperse 13940 (polyester amine based)" (trade name), "Solsperse 17000" (trade name), "Solsperse 18000" (trade name), "Solsperse 19000 (fatty acid amine based)" (trade name), or "Solsperse 11200" (trade name) manufactured by Japan Lubrizol Limited.

Further preferred examples of the basic high-polymer dispersant include a copolymer of a compound containing an atom group expressed in a chemical formula (II) below and a compound containing an atom group expressed in a chemical formula (III) below (that is, a copolymer of a vinyl compound having a long-chain alkyl group and polyvinylpyrrolidone). Examples of such a copolymer include "Antaron V-216" (trade name), "Antaron V-220" (trade name), or "Antaron W-660" (trade name) manufactured by GAF Corporation/ISP Chemicals Inc.

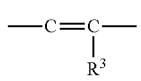

(II)

-continued (III)

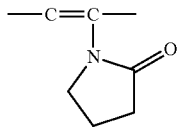

In the chemical formula (II) above, $R^3$ represents an alkyl group having a carbon number from 10 to 30. Though a copolymerization ratio (a molar ratio) between the atom group expressed by the chemical formula (II) and the atom group expressed by the chemical formula (III) is not particularly limited, a range from 20:80 to 90:10 is preferred and a range from 50:50 to 90:10 is more preferred. When a ratio of the atom group expressed by the chemical formula (III) is low, dispersibility of toner particles may become poor. When the carbon number of $R^3$ in the chemical formula (II) is smaller than 10, dispersibility of the toner particles may become poor. When the carbon number of $R^3$ in the chemical formula (II) exceeds 30, the basic high-polymer dispersant is less likely to be dissolved in an insulating liquid.

As the basic high-polymer dispersant, a material above may be used alone or two or more types of the materials above may be used as combined. Another dispersant such as a basic low-molecular-weight dispersant or an acid dispersant may be used as the toner dispersant, together with the basic high-polymer dispersant.

Manufacturing of Toner Particles

Though a method of manufacturing toner particles in the present embodiment is not particularly limited, the toner particles in the present embodiment can be manufactured based on such a conventionally known technique as a granulation method or a crushing method.

The crushing method is a method in which a resin and a coloring agent such as a pigment are molten and mixed and then the mixture is crushed. Crushing is carried out in a dry state or a wet state such as in an insulating liquid.

The granulation method includes a suspension polymerization method, an emulsion polymerization method, a fine particle aggregation method, a method of adding a poor solvent to a resin solution for precipitation of toner particles, or a spray drying method, depending on a difference in mechanism for forming toner particles.

In order to obtain toner particles having a small diameter and sharp particle size distribution, the granulation method rather than the crushing method is preferably adopted. A resin high in meltability or a resin high in crystallinity is soft even at a room temperature and less likely to be crushed. Therefore, with the crushing method, a particle size of toner particles cannot be controlled to a desired particle size in some cases. With the granulation method, on the other hand, toner particles having a desired particle size can be obtained.

More preferably, the method of adding a poor solvent to a resin solution for precipitation of toner particles is adopted. In this method, initially, a resin solution is obtained by dissolving a resin in a good solvent. Then, the resin solution is mixed, together with an interfacial tension adjuster (a toner dispersant), in a poor solvent (different in SP value from the good solvent), and thereafter shear is provided to form a droplet. Thereafter, by volatilizing the good solvent, toner particles are obtained. With this method, a particle size or a shape of toner particles can highly be controlled by adjusting as appropriate how to provide shear, difference in interfacial tension, or an interfacial tension adjuster (a toner dispersant). Therefore, this method is suitable as a method of obtaining toner particles having desired particle size distribution and a desired shape.

EXAMPLES

Though the present invention will be described hereinafter in further detail with reference to Examples, the present invention is not limited thereto.

Manufacturing Example 1

Synthesis of Adduct of Propylene Oxide (PO) to Bisphenol A

In an autoclave provided with a stirring and temperature adjustment function, bisphenol A (228 g) and potassium hydroxide (2 g) were introduced and a temperature was raised to 135° C. Thereafter, propylene oxide (139 g) was introduced under a pressure condition from 0.1 to 0.4 MPa, and thereafter reaction was allowed for 3 hours. An adsorbent (trade name "Kyowaad® 600" manufactured by Kyowa Chemical Industry Co., Ltd.) (16 g) was introduced in the thus obtained reaction product, which was stirred and aged for 30 minutes while the temperature was held at 90° C. Thereafter, filtration was carried out to thereby obtain an adduct of propylene oxide to bisphenol A. This adduct of propylene oxide was a mixture of a compound in which the sum (m+n) of m and n in the chemical formula (I) was 2 and a compound in which the sum (m+n) of m and n in the chemical formula (I) was 3.

Manufacturing Example 2

Synthesis of Aliphatic Polyester Resins A to C

In a four-neck flask to which a stirring rod, a partial condenser, a nitrogen gas introduction pipe, and a thermometer were attached, 1,6-hexanediol (an aliphatic monomer, a constitutional unit derived from an alcohol component) and adipic acid (an aliphatic monomer, a constitutional unit derived from an acid component) were introduced (at a molar ratio of approximately 1:1). A nitrogen gas was introduced while stirring was carried out, and tetrabutoxytitanate was added as a polymerization catalyst for condensation polymerization for 5 hours at a temperature of approximately 170° C. To an obtained aliphatic polyester resin A, 0.2 mass % of tetrabutoxytitanate (a polymerization catalyst) was added.

Then, the temperature was lowered to approximately 100° C., and condensation polymerization was stopped by adding 0.012 part by mass of hydroquinone (a polymerization inhibitor) to 100 parts by mass of the product. Aliphatic polyester resin A was thus obtained.

A molar ratio in mixing between 1,6-hexanediol and adipic acid was varied and a condition for condensation polymerization was varied, so as to obtain an aliphatic polyester resin B and an aliphatic polyester resin C.

An acid value of aliphatic polyester resins A to C was measured in compliance with the method described under JIS K 0070: 1992 (test methods for acid value, saponification value, ester value, iodine value, hydroxyl value and unsaponifiable matter of chemical products). Table 1 shows results.

Mn of aliphatic polyester resins A to C was measured with GPC. Table 1 shows results.

TABLE 1

| Type of Aliphatic Polyester Resin | Constitutional Unit of Alcohol Component | Constitutional Unit of Acid Component | Content of Constitutional Unit Derived from Aliphatic Monomer (Mass %)*11 | Acid Value (mgKOH/g) | Mn |
|---|---|---|---|---|---|
| A | 1,6-hexanediol | Adipic Acid | 100 | 0 | 7000 |
| B | 1,6-hexanediol | Adipic Acid | 100 | 15 | 6000 |
| C | 1,6-hexanediol | Adipic Acid | 100 | 30 | 3000 |

In Table 1, "content of constitutional unit derived from aliphatic monomer (mass %)*11" means a content of a constitutional unit derived from an aliphatic monomer in both constitutional units of a constitutional unit derived from an alcohol component and a constitutional unit derived from an acid component in an aliphatic polyester resin.

Manufacturing Example 3

Synthesis of Aromatic Polyester Resins a and b

In a four-neck flask to which a stirring rod, a partial condenser, a nitrogen gas introduction pipe, and a thermometer were attached, the adduct of PO to bisphenol A (an aromatic monomer, a constitutional unit derived from an alcohol component) obtained in Manufacturing Example 1 and isophthalic acid (an aromatic monomer, a constitutional unit derived from an acid component) were introduced (at a molar ratio of approximately 1:1). A nitrogen gas was introduced while stirring was carried out, and tetrabutoxytitanate was added as a polymerization catalyst for condensation polymerization for 5 hours at a temperature of approximately 170° C. To an obtained aromatic polyester resin a, 0.2 mass % of tetrabutoxytitanate (a polymerization catalyst) was added.

Then, the temperature was lowered to approximately 100° C., and condensation polymerization was stopped by adding 0.012 part by mass of hydroquinone (a polymerization inhibitor) to 100 parts by mass of the product. Aromatic polyester resin a was thus obtained.

A molar ratio in mixing between the adduct of PO to bisphenol A and isophthalic acid was varied and a condition for condensation polymerization was varied, so as to obtain an aromatic polyester resin b. An acid value and Mn of aromatic polyester resins a and b were measured in accordance with the method described in Manufacturing Example 2. Table 2 shows results.

TABLE 2

| Type of Aromatic Polyester Resin | Constitutional Unit of Alcohol Component | Constitutional Unit of Acid Component | Content of Constitutional Unit Derived from Aromatic Monomer (Mass %)*21 | Acid Value (mgKOH/g) | Mn |
|---|---|---|---|---|---|
| a | Adduct of PO to Bisphenol A | Isophthalic Acid | 100 | 0 | 4000 |
| b | Adduct of PO to Bisphenol A | Isophthalic Acid | 100 | 20 | 3500 |

TABLE 2-continued

| Type of Aromatic Polyester Resin | Constitutional Unit of Alcohol Component | Constitutional Unit of Acid Component | Content of Constitutional Unit Derived from Aromatic Monomer (Mass %)*21 | Acid Value (mgKOH/g) | Mn |
|---|---|---|---|---|---|
| c | Adduct of PO to Bisphenol A | Isophthalic Acid and Trimellitic Acid | 100 | 25 | 3500 |
| d | Adduct of PO to Bisphenol A | Isophthalic Acid and Trimellitic Acid | 100 | 30 | 3500 |
| e | Adduct of PO to Bisphenol A | Isophthalic Acid and Trimellitic Acid | 100 | 35 | 3000 |
| f | Adduct of PO to Bisphenol A | Isophthalic Acid and Trimellitic Acid | 100 | 70 | 2000 |

In Table 2, "content of constitutional unit derived from aromatic monomer (mass %)*21" means a content of a constitutional unit derived from an aromatic monomer in both constitutional units of a constitutional unit derived from an alcohol component and a constitutional unit derived from an acid component in an aromatic polyester resin.

Manufacturing Example 4

Synthesis of Aromatic Polyester Resins c to f

In a four-neck flask to which a stirring rod, a partial condenser, a nitrogen gas introduction pipe, and a thermometer were attached, the adduct of PO to bisphenol A (an aromatic monomer, a constitutional unit derived from an alcohol component) obtained in Manufacturing Example 1, isophthalic acid (an aromatic monomer, a constitutional unit derived from an acid component), and trimellitic acid (an aromatic monomer, a constitutional unit derived from an acid component) were introduced (at a molar ratio of approximately 1:0.95:0.05). A nitrogen gas was introduced while stirring was carried out, for condensation polymerization for 5 hours at a temperature of approximately 170° C.

Then, the temperature was lowered to approximately 100° C., and condensation polymerization was stopped by adding 0.012 part by mass of hydroquinone (a polymerization inhibitor) to 100 parts by mass of the product. An aromatic polyester resin c was thus obtained.

A molar ratio in mixing among the adduct of PO to bisphenol A, isophthalic acid, and trimellitic acid was varied and a condition for condensation polymerization was varied, so as to obtain aromatic polyester resins d to f. An acid value and Mn of aromatic polyester resins c to f were measured in accordance with the method described in Manufacturing Example 2. Table 2 shows results.

Manufacturing Example 5

Manufacturing of Dispersion Liquid of Coloring Agent

In a beaker, 20 parts by mass of copper phthalocyanine (a coloring agent, trade name "FASTGEN Blue FDB-14" manufactured by DIC Corporation), 5 parts by mass of a dispersant for pigment (trade name "Ajisper PB-821" manufactured by Ajinomoto Fine-Techno Co., Inc.), and 75 parts by mass of acetone were introduced After copper phthalocyanine was uniformly dispersed, it was finely dispersed with the use of a bead mill. Thus, a dispersion liquid of a coloring agent was obtained. A volume average particle size of copper phthalocyanine in the dispersion liquid of the coloring agent was 0.2 μm.

Manufacturing Example 6

Manufacturing of Solution Y1 for Forming Resin

A solution Y1 for forming a resin was obtained by dissolving 20 parts by mass of aliphatic polyester resin A and 80 parts by mass of aromatic polyester resin e in 150 parts by mass of acetone.

Manufacturing Example 7

Manufacturing of Solution Y2 for Forming Resin

A solution Y2 for forming a resin was obtained by dissolving 20 parts by mass of aliphatic polyester resin B and 80 parts by mass of aromatic polyester resin f in 150 parts by mass of acetone.

Example 1

A Henschel mixer was used to sufficiently mix 5 parts by mass of aliphatic polyester resin A, 95 parts by mass of aromatic polyester resin e, and 20 parts by mass of copper phthalocyanine (a coloring agent, trade name "FASTGEN Blue FDB-14" manufactured by DIC Corporation). Thereafter, the mixture was cooled after it was molten and mixed with the use of a twin screw extruder. The obtained solid was coarsely crushed and thereafter finely crushed with the use of a jet mill. Toner particles having an average particles size of 6 μm were thus obtained.

After 34 parts by mass of obtained toner particles, 1 part by mass of a toner dispersant (a basic high-polymer dispersant, trade name "Antaron V-216" manufactured by GAF Corporation/ISP Chemicals Inc.), 100 parts by mass of an insulating liquid (trade name "IP Solvent 2028" manufactured by Idemitsu Kosan Co., Ltd.), and 100 parts by mass of zirconia beads were mixed, they were stirred for 50 hours with the use of a sand mill. A liquid developer in the present Example was thus obtained.

Examples 2, 4, and 6 to 9 and Comparative Examples 1 to 3

A liquid developer was manufactured in accordance with the method described in Example 1 except for change in type or content of an aliphatic polyester resin or a type or a content of an aromatic polyester resin as shown in Table 3.

TABLE 3

| | Resin | | | | | | | | | Toner Particles | | | |
|---|---|---|---|---|---|---|---|---|---|---|---|---|---|
| | Aliphatic Polyester Resin | | | Aromatic Polyester Resin | | | Difference in Acid Value (mgKOH/g) | Acid Value of Resin (mgKOH/g) | Toner Dispersant | Manufacturing Method | Median Diameter D (μm) | Proneness of Aggregation | Fixability |
| | Type | Content (Mass %) | Acid Value (mgKOH/g) | Type | Content (Mass %) | Acid Value (mgKOH/g) | | | | | | | |
| Example 1 | A | 5 | 0 | e | 95 | 35 | 35 | 33 | V216 | Crushing | 2.2 | A1 | A2 |
| Example 2 | A | 20 | 0 | e | 80 | 35 | 35 | 28 | V216 | Crushing | 1.8 | A1 | A2 |
| Example 3 | A | 20 | 0 | e | 80 | 35 | 35 | 28 | S11200 | Granulation | 1.9 | A1 | A2 |
| Example 4 | A | 30 | 0 | e | 70 | 35 | 35 | 25 | V216 | Crushing | 2.5 | A1 | A2 |
| Example 5 | B | 20 | 15 | f | 80 | 70 | 55 | 59 | S11200 | Granulation | 1.6 | A1 | A2 |
| Example 6 | C | 30 | 30 | a | 70 | 0 | 30 | 9 | V216 | Crushing | 2.2 | A1 | B2 |
| Example 7 | B | 20 | 15 | e | 80 | 35 | 20 | 31 | V216 | Crushing | 2.3 | A1 | A2 |
| Example 8 | B | 20 | 15 | d | 80 | 30 | 15 | 27 | V216 | Crushing | 1.7 | B1 | A2 |
| Example 9 | A | 20 | 0 | b | 80 | 20 | 20 | 16 | V216 | Crushing | 2.2 | A1 | B2 |
| Comparative Example 1 | — | 0 | 0 | e | 100 | 35 | — | 35 | V216 | Crushing | 2.3 | A1 | C2 |
| Comparative Example 2 | A | 35 | 0 | e | 65 | 35 | 35 | 23 | V216 | Crushing | 1.7 | C1 | A2 |
| Comparative Example 3 | B | 20 | 15 | c | 80 | 25 | 10 | 23 | V216 | Crushing | 2.2 | C1 | A2 |

Example 3

In a beaker, 40 parts by mass of solution Y1 for forming a resin and 20 parts by mass of the dispersion liquid of the coloring agent (Manufacturing Example 5) were introduced, which was stirred with TK Auto Homo Mixer (manufactured by Tokushu Kika Kogyo Co., Ltd.) at 25° C. at 8000 rpm, so that the coloring agent was uniformly dispersed. A resin solution was thus obtained.

Then, 15 parts by mass of a toner dispersant (a basic high-polymer dispersant, trade name "Solsperse 11200" (manufactured by Japan Lubrizol Limited) was dissolved in 85 parts by mass of an insulating liquid (trade name "IP Solvent 2028" manufactured by Idemitsu Kosan Co., Ltd.). A dispersant solution was thus obtained.

In another beaker, 67 parts by mass of an insulating liquid (trade name "IP Solvent 2028" manufactured by Idemitsu Kosan Co., Ltd.) and 11 parts by mass of the dispersant solution were introduced and uniformly dispersed. Thereafter, while TK Auto Homo Mixer was used at 25° C. to perform stirring at 10000 rpm, 60 parts by mass of the resin solution was introduced and stirred for 2 minutes. The obtained liquid mixture was introduced in a reaction vessel provided with a stirrer, a heating and cooling apparatus, a thermometer, and a desolventizer, and a temperature was raised to 35° C. Thereafter, at a reduced pressure of 0.039 MPa at that temperature, acetone was distilled out until a concentration of acetone was not higher than 0.5 mass %. Thus, a liquid developer was obtained.

Example 5

A liquid developer was obtained in accordance with the method described in Example 3 except for change of solution Y1 for forming a resin to solution Y2 for forming a resin.

Measurement of Average Particle Size of Toner Particles

A flow particle image analyzer (trade name "FPIA-3000" manufactured by Sysmex Corporation) was used to measure an average particle size of toner particles in the liquid developer. Trade name "IP Solvent 2028" (manufactured by Idemitsu Kosan Co., Ltd.) which was the same solvent as that for the insulating liquid was employed as a flow solvent. In a flow solvent (20 g) containing 30 mg of a dispersant (trade name "Solsperse S13940" manufactured by Japan Lubrizol Limited), 50 mg of toner particles was added. An ultrasound disperser (trade name "ultrasonic cleaner model VS-150" manufactured by Velvo-Clear) was used to subject the resultant suspension to dispersion treatment for approximately 5 minutes. A median diameter D50 of toner particles of a sample thus obtained was measured. Table 3 shows results.

Evaluation of Resistance to Aggregation

Proneness of aggregation of toner particles was examined with the use of an apparatus shown in FIG. 1. Initially, a median diameter D50 of the toner particles (a median diameter D50 before rotation) was found in accordance with the method described above. Then, 200 g of a liquid developer 21 was introduced in a development tank 1, and a first roller 3 and a second roller 5 which rotate in the same direction were arranged as shown in FIG. 1. In the apparatus shown in FIG. 1, liquid developer 21 is brought up by first roller 3 and sent to second roller 5. After first roller 3 and second roller 5 were rotated for 3 hours, a median diameter D50 of toner particles (a median diameter D50 after rotation) was found. A rate of change in median diameter D50 of the toner particles was found with the use of an expression below. Table 3 shows results.

(Rate of Change in Median Diameter *D*50 of Toner Particles)=(Median Diameter *D*50 After Rotation)÷(Median Diameter *D*50 Before Rotation)

In Table 3, a rate of change in median diameter D50 of toner particles less than 1.2 is denoted as "A1", a rate of change in median diameter D50 of toner particles not less than 1.2 and less than 1.5 is denoted as "B1", and a rate of change in median diameter D50 of toner particles not less than 1.5 is denoted as "C1". A lower rate of change in median diameter D50 of toner particles indicates less likeliness of aggregation of toner particles (toner particles being excellent in resistance to aggregation).

Evaluation of Fixability

Initially, an image was formed on a recording medium (OK top coat+, 128 g/m$^2$, manufactured by Oji Paper Co., Ltd.) in accordance with a method which will be described later. An amount of adhesion of toner particles to the recording medium was 3 g/m$^2$. Thereafter, a yet-to-be-fixed image was fixed to the recording medium with the use of a heat roller fixer. Here, a set temperature of the roller was 100° C., a fixation NIP time was set to 30 msec., and a temperature of the recording medium immediately after passage of the heat roller fixer was 80° C.

Then, a tape (trade name "Scotch® mending tape" manufactured by Sumitomo 3M Limited) was stuck to a site of interest of measurement in the recording medium to which the image was fixed, and thereafter the tape was peeled off. Then, a reflection densitometer (trade name: "X-Rite model 404" manufactured by X-Rite, Incorporated) was used to find an image density (ID) of the image peeled off by the tape. Table 3 shows results.

In Table 3, an image density less than 0.1 is denoted as "A2", an image density not less than 0.1 and less than 0.15 is denoted as "B2", and an image density not less than 0.15 is denoted as "C2". A lower image density can be concluded to indicate better fixability of toner particles because a fixed image is less likely to be peeled off by the tape. In the present Examples, the set temperature of the roller during fixation was 100° C. and the temperature of the recording medium immediately after passage of the heat roller fixer was 80° C. Therefore, it can be concluded that fixation at a low temperature could be realized if the image density was low.

Formation of Image

Figure 2:
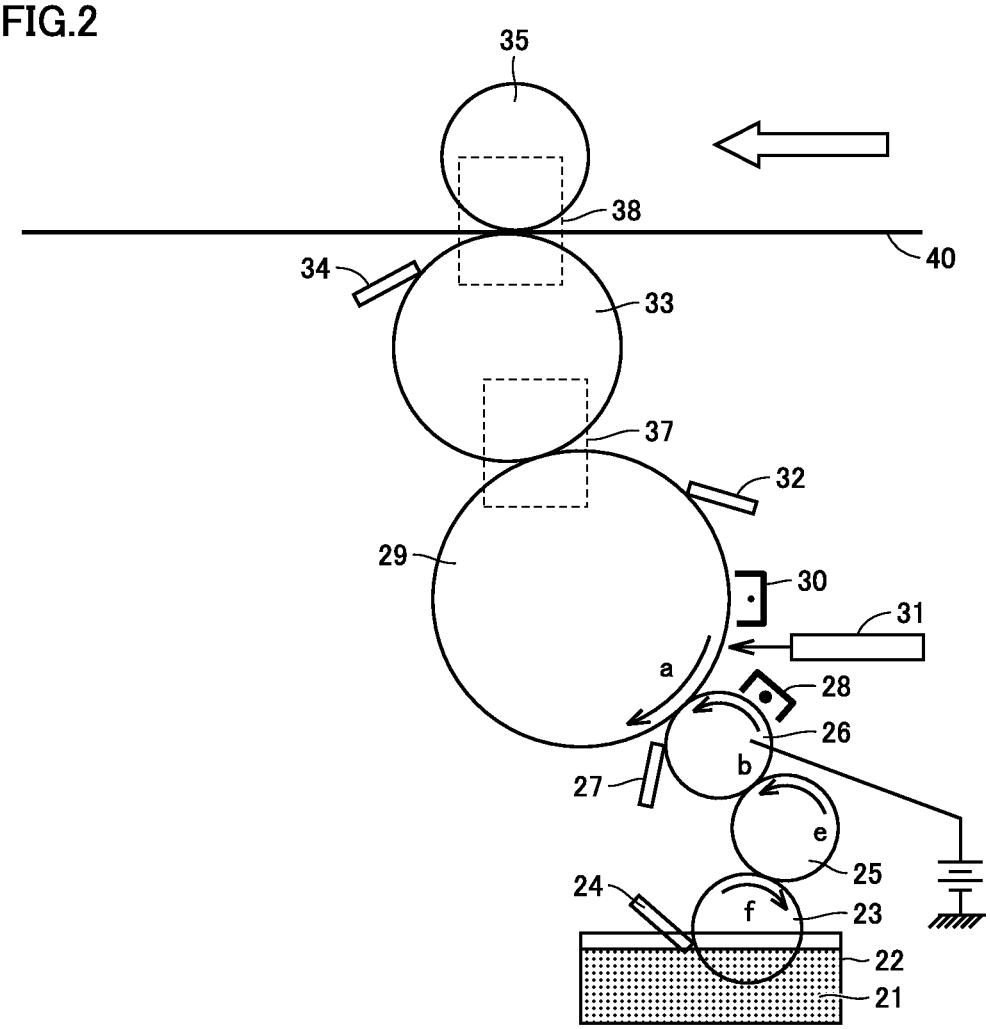
FIG. 2 is a schematic conceptual diagram of a part of an image formation apparatus of an electrophotography type.

An image was formed by using an image formation apparatus shown in FIG. 2. A construction of the image formation apparatus shown in FIG. 2 is shown below. Liquid developer 21 is brought up from a development tank 22 by an anilox roller 23. Excessive liquid developer 21 on anilox roller 23 is scraped off by an anilox restriction blade 24, and remaining liquid developer 21 is sent to a leveling roller 25. Liquid developer 21 is adjusted to be uniform and small in thickness, on leveling roller 25.

Liquid developer 21 on leveling roller 25 is sent to a development roller 26. Liquid developer 21 on development roller 26 is charged by a development charger 28 and developed on a photoconductor 29, and the excessive liquid developer is scraped off by a development cleaning blade 27.

Specifically, a surface of photoconductor 29 is evenly charged by a charging portion 30, and an exposure portion 31 arranged around photoconductor 29 emits light based on prescribed image information to the surface of photoconductor 29. Thus, an electrostatic latent image based on the prescribed image information is formed on the surface of photoconductor 29. As the formed electrostatic latent image is developed, a toner image is formed on photoconductor 29. The excessive liquid developer on photoconductor 29 is scraped off by a cleaning blade 32.

The toner image formed on photoconductor 29 is primarily transferred to an intermediate transfer element 33 at a primary transfer portion 37, and the liquid developer transferred to intermediate transfer element 33 is secondarily transferred to a recording medium 40 at a secondary transfer portion 38. The liquid developer which remained on intermediate transfer element 33 without being secondarily transferred is scraped off by an intermediate transfer element cleaning portion 34.

In the present Example, the surface of photoconductor 29 was positively charged by charging portion 30, a potential of intermediate transfer element 33 was set to −400 V, and a potential of a secondary transfer roller 35 was set to −1200 V. A velocity of transportation of recording medium 40 was set to 400 mm/s.

Discussion

As shown in Table 3, fixability was lower in Comparative Example 1 than in Examples 1 to 9. It can be concluded from this result that toner particles preferably contain at least 5 mass % of an aliphatic polyester resin.

In Comparative Example 2, aggregation was more likely (resistance to aggregation was lower) than in Examples 1 to 9. It can be concluded from this result that toner particles preferably contain at most 30 mass % of an aliphatic polyester resin.

In Comparative Example 3, aggregation was more likely (resistance to aggregation was lower) than in Examples 1 to 9. It can be concluded from this result that a difference in acid value is preferably not less than 15 mgKOH/g.

Examples 1 to 5, 7, and 8 were better in fixability than Examples 6 and 9. It can be concluded from this result that a resin further preferably has an acid value not less than 20 mgKOH/g.

In Examples 1 to 7 and 9, aggregation was less likely (resistance to aggregation was better) than in Example 8. It can be concluded from this result that a difference in acid value is preferably not less than 20 mgKOH/g.

Though the embodiment of the present invention has been described, it should be understood that the embodiment disclosed herein is illustrative and non-restrictive in every respect. The scope of the present invention is defined by the terms of the claims and is intended to include any modifications within the scope and meaning equivalent to the terms of the claims.

What is claimed is:

1. A liquid developer, comprising:

an insulating liquid; and toner particles dispersed in said insulating liquid, said toner particles having a resin and a coloring agent, said resin containing at least 5 mass % and at most 30 mass % of an aliphatic polyester resin and at least 70 mass % and at most 95 mass % of an aromatic polyester resin, and a difference in acid value between said aliphatic polyester resin and said aromatic polyester resin being not less than 15 mgKOH/g and not more than 100 mgKOH/g.

2. The liquid developer according to claim 1, wherein said resin has an acid value not less than 20 mgKOH/g and not more than 100 mgKOH/g.

3. The liquid developer according to claim 1, wherein the difference in acid value between said aliphatic polyester resin and said aromatic polyester resin is not less than 20 mgKOH/g and not more than 100 mgKOH/g.

4. The liquid developer according to claim 1, wherein said resin contains at least 5 mass % and at most 25 mass % of said aliphatic polyester resin.

* * * * *